US008758081B2

(12) United States Patent
Yuasa et al.

(10) Patent No.: US 8,758,081 B2
(45) Date of Patent: Jun. 24, 2014

(54) GARMENT WITH CUP SECTION

(75) Inventors: Masaru Yuasa, Kyoto (JP); Megumi Tachiiri, Kyoto (JP)

(73) Assignee: Wacoal Corp., Kyoto (JP)

( * ) Notice: Subject to any disclaimer, the term of this patent is extended or adjusted under 35 U.S.C. 154(b) by 332 days.

(21) Appl. No.: 13/262,101

(22) PCT Filed: Mar. 31, 2010

(86) PCT No.: PCT/JP2010/055831
§ 371 (c)(1),
(2), (4) Date: Nov. 21, 2011

(87) PCT Pub. No.: WO2010/114016
PCT Pub. Date: Oct. 7, 2010

(65) Prior Publication Data

US 2012/0164915 A1 Jun. 28, 2012

(30) Foreign Application Priority Data

Mar. 31, 2009 (JP) ..... 2009-085558

(51) Int. Cl.
*A41C 3/00* (2006.01)

(52) U.S. Cl.
USPC ..... 450/31; 450/59; 450/60

(58) Field of Classification Search
USPC ..... 450/30–33, 58–60, 63, 69, 71, 72, 79, 450/80
See application file for complete search history.

(56) References Cited

U.S. PATENT DOCUMENTS

| | | | | | |
|---|---|---|---|---|---|
| 2,449,808 | A | * | 9/1948 | Glick | 450/79 |
| 2,553,225 | A | * | 5/1951 | Weaver et al. | 450/59 |
| 2,607,038 | A | * | 8/1952 | Spare | 450/59 |
| 2,706,816 | A | * | 4/1955 | Dozier | 450/36 |
| 2,963,023 | A | * | 12/1960 | Clover | 450/59 |
| 3,054,408 | A | * | 9/1962 | Cousins | 450/60 |
| 3,302,649 | A | * | 2/1967 | Bruno | 450/63 |

FOREIGN PATENT DOCUMENTS

| | | | |
|---|---|---|---|
| EP | 0 873 693 | A1 | 10/1998 |
| JP | 7-097701 | A | 4/1995 |
| JP | 10-259509 | A | 9/1998 |
| JP | 2005-089881 | A | 4/2005 |

(Continued)

OTHER PUBLICATIONS

Office Action CN Application No. 201080015129.X, dated Apr. 3, 2013.

(Continued)

*Primary Examiner* — Gloria Hale
(74) *Attorney, Agent, or Firm* — Leydig, Voit & Mayer, Ltd.

(57) ABSTRACT

A cup-possessing garment 1 according to an embodiment of the present invention is provided with a pair of cup sections 12 for covering respective breasts and a pair of gathering sections 20 provided so as to cover at least a part of a front face of each cup section 12 in order to gather the pair of cup sections toward the front center, and each of the pair of gathering sections 20 is composed of a first portion 22 attached to a side portion of the cup section 12, and a second portion 24 formed with higher elasticity than the first portion 22 and formed in such a manner that ends of the second portions on the front center side join together in order to connect the first portions 22 to each other on the front center side.

6 Claims, 18 Drawing Sheets

(56) References Cited

FOREIGN PATENT DOCUMENTS

| | | | |
|---|---|---|---|
| JP | 2005-206949 | A | 8/2005 |
| JP | 3118029 | U | 2/2006 |
| JP | 3118931 | U | 2/2006 |
| JP | 2006-063470 | A | 3/2006 |
| JP | 2007-321249 | A | 12/2007 |
| JP | 2008-025056 | A | 2/2008 |
| JP | 2008-214777 | A | 9/2008 |
| JP | 2009-030203 | A | 2/2009 |

OTHER PUBLICATIONS

JP Office Action, Appln, No. P2009-085558, mailed Jan. 29, 2013.

International Search Report for PCT/JP2010/055831 mailed Jul. 6, 2010.

International Preliminary Report on Patentability (IPRP—Chapter 1) for PCT/JP2010/055831 mailed, Nov. 24, 2011.

* cited by examiner (a)

(b)

GARMENT WITH CUP SECTION

TECHNICAL FIELD

The present invention relates to a cup-possessing garment for covering each breast.

BACKGROUND ART

Patent Literatures 1 to 3 disclose brassieres as cup-possessing garments for covering breasts. These brassieres are provided with gathering members for gathering the right and left cup sections toward the front center, in order to enhance the breast gathering effect and push-up effect. The gathering members have their one ends fixed to cup side portions and a base section and the other ends extending as tapered toward the front center part to be connected to each other.

CITATION LIST

Patent Literatures

Patent Literature 1: Japanese Patent Application Laid-open No. 2007-321249

Patent Literature 2: Registered Japanese Utility Model No. 3118029

Patent Literature 3: Registered Japanese Utility Model No. 3118931

SUMMARY OF INVENTION

Technical Problem

Incidentally, if shaping performance such as the breast gathering and push-up effects is enhanced too high in the cup-possessing garments, some users could also feel too tight at portions other than breasts. For example, in the case of the brassieres as described in Patent Literatures 1 to 3, the gathering members are sewn at sewn portions of back belt sections and at sewn portions of shoulder strap sections and for this reason the users may feel too tight at the back belt and shoulder strap sections.

It is therefore an object of the present invention to provide a cup-possessing garment achieving high breast shaping performance and comfortable wear feeling together.

Solution to Problem

A cup-possessing garment according to the present invention is one comprising: a pair of cup sections for covering respective breasts; and a pair of gathering sections provided so as to cover at least partial areas of front faces of the respective cup sections in order to gather the pair of cup sections toward a front center, wherein each of the pair of gathering sections is composed of a first portion attached to a side portion of the cup section, and a second portion formed with higher elasticity than the first portion and formed in such a manner that ends of the second portions on the front center side join together in order to connect the first portions to each other on the front center side.

In this cup-possessing garment, the second portions in the gathering sections act to gather the breasts forward. On the other hand, the first portions in the gathering sections are attached to the side portions of the respective cup sections and act to hold the side portions of the breasts because they have the lower elasticity than the second portions. Therefore, gathering forces by the second portions can be efficiently transferred from the first portions to the side portions of the breasts, so as to enhance the breast shaping performance.

Since the first portions efficiently transfer the gathering forces by the second sections to the breasts, it is feasible to prevent the gathering forces by the second sections from being transferred to the other portions of the garment and thus to suppress the tight pressure feeling due to the other portions of the garment. For example, in a brassiere with back belt sections, the gathering forces by the second portions are prevented from being transferred to the back belt sections, so as to suppress the tight pressure feeling due to the back belt sections. Accordingly, this cup-possessing garment achieves the high breast shaping performance and the comfortable wear feeling together.

Preferably, the second portions in the pair of gathering sections as described above are configured in such a manner that forces in a mutually engaged state thereof to push the cup sections toward the breasts become gradually stronger from an upper side to a lower side. This configuration lets the gathering sections act to push the breasts up, thereby further enhancing the breast shaping performance.

Preferably, the second portion in the gathering section as described above has a virtually triangular shape the base of which extends along a verge's line, such that its width gradually decreases from the first portion toward the front center. In this configuration, the horizontal length of the second portion gradually decreases from the upper side to the lower side. As a consequence thereof, the elasticity of the second portion becomes gradually weaker from the upper side to the lower side, whereby the force of the second portion to push the cup section toward the breast becomes gradually stronger from the upper side to the lower side. Therefore, the breast shaping performance is more enhanced as described above.

The cup-possessing garment as described above is preferably configured as follows: it further comprises: a shoulder strap section coupled to the cup section; one end of the second portion in the gathering section is sewn to the first portion in a range of virtually three quarters of a length from near a lowermost part of the verge's line to near an attaching portion of the shoulder strap section, ranging from the lowermost part of the verge's line; the other end of the second portion in the gathering section engages with the other second portion in the pair of gathering sections, at a position on the front center corresponding to a range of virtually two thirds of a normal from a bust top to a lowermost line connecting the lowermost parts of the right and left verge's lines, ranging from the lowermost line. In this configuration, the second portion comes to have the virtually triangular shape the base of which extends along the verge's line, such that the width thereof gradually decreases from the first portion toward the front center. Therefore, the breast shaping performance is more enhanced as described above.

The cup-possessing garment as described above is preferably configured as follows: it further comprises: a shoulder strap section coupled to the cup section; the aforementioned cup section is formed in such a manner that the side portion is joined to a member constituting the other portion, along a line extending from near an attaching portion of the shoulder strap section via the vicinity of a lowermost part of a verge's line. This configuration achieves efficient hold of the breast side portions, which is effective to gathering and pushing up the breasts. Therefore, the breast shaping performance is more enhanced as described above. Furthermore, as described above, the gathering forces by the second portions are more prevented from being transferred to the other portions of the garment, whereby the tight pressure feeling due to the other portions of the garment is further suppressed.

Preferably, the pair of gathering sections as described above further have respective engagement portions for engaging the second portions with each other. This configuration allows the garment to be worn as follows: the side portions of the breasts are first held by the first portions and then the second portions are engaged with each other to efficiently gather and push up only the breasts from the breast side portions toward the front center. Therefore, the breast shaping performance is more enhanced and the tight pressure feeling due to the other portions of the garment is more suppressed.

Preferably, the cup-possessing garment as described above further comprises: a fastening portion for fastening the engagement portion. This configuration allows the fastening portion to fasten the engagement portion and the second portion so as not to become obstacles when the garment is worn with the engagements portions being disengaged.

Advantageous Effects of Invention

The present invention provides the cup-possessing garment achieving the high breast shaping performance and the comfortable wear feeling together.

DESCRIPTION OF EMBODIMENTS

The preferred embodiments of the cup-possessing garment according to the present invention will be described below in detail with reference to the drawings.

Figure 1:
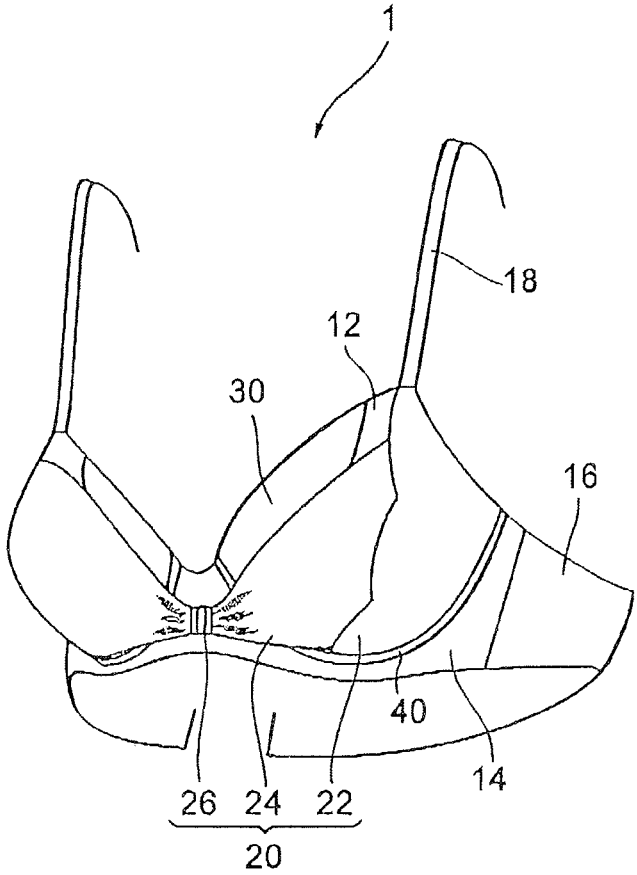
FIG. 1 is a perspective view showing a brassiere according to an embodiment of the present invention.
Figure 2:
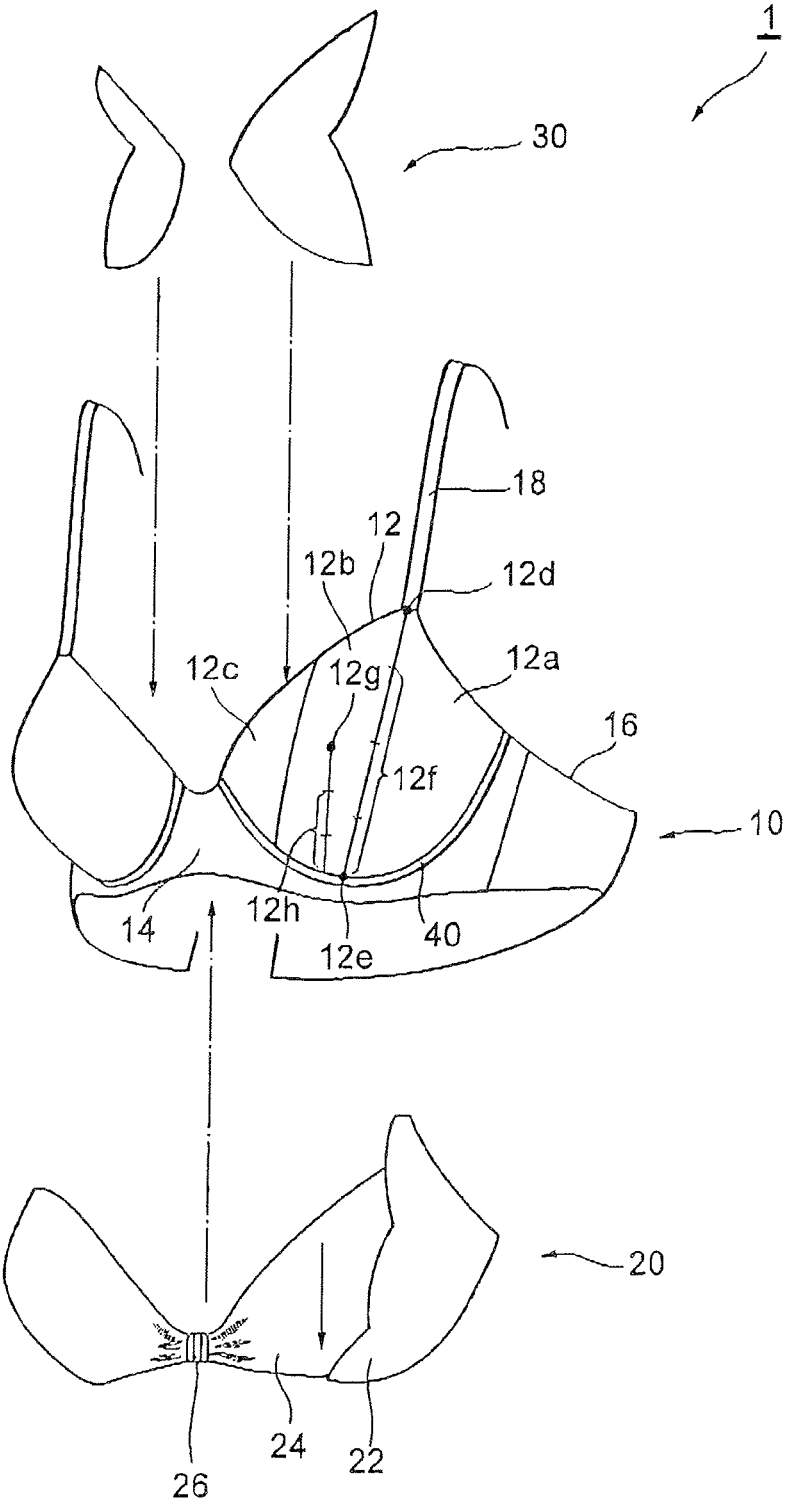
FIG. 2 is an exploded perspective view showing an exploded state of the brassiere shown in FIG. 1.

FIG. 1 is a perspective view showing a brassiere according to an embodiment of the present invention and FIG. 2 an exploded perspective view showing an exploded state of the brassiere shown in FIG. 1. The brassiere 1 is provided with a main body section 10, a pair of gathering sections 20, and a pair of fabric members 30. Since the brassiere 1 is bilaterally symmetric, the description below will be based on only one of the right and left parts.

The main body section 10 has cup sections 12, a base section 14, back belt sections 16, and shoulder strap sections 18.

The cup section 12 is provided for covering a breast and is supported on the base section 14. The base section 14 is comprised of nonelastic fabric and is sewn to the cup section from the lower part to the side of the cup section 12. The back belt section 16 is sewn to the side of the base section 14. The back belt sections 16 are comprised of elastic fabric and are coupled at the back to support the base section 14 and the cup sections 12. The shoulder strap section 18 is sewn to the side upper part of the cup section 12. The shoulder strap section 18 is comprised of elastic fabric and is coupled to the back belt section 16 via shoulder, thereby to support the cup section 12.

A cup wire 40 is set at a border between the cup section 12 and the base section 14. The border between the cup section 12 and the base section 14 is arranged, for example, along a verge's line. It is noted that the cup wire 40 does not always have to be provided. The gathering section 20 is provided on the front side of the cup section 12.

The gathering section 20 is provided so as to cover the front face (the face opposite to the face where the cup section 12 covers the breast, so called skin-side face) and is a member for gathering the breast toward the front center. The gathering section 20 has a first portion 22, a second portion 24, and an engagement portion 26.

The first portion 22 is sewn to side portion 12*a* out of side portion 12*a*, central portion 12*b*, and front center portion 12*c* obtained by dividing the cup section into three regions in the horizontal direction. For example, the first portion 22 is sewn around the edge of the side portion 12*a*. The elasticity of the first portion 22 is lower than that of the second portion 24. For example, a material with a smaller slope of SS curve than the second portion is applied to the first portion 22. A nonelastic member may be applied to the first portion 22. This results in letting the first portion 22 act to hold the side portion of the breast. In the embodiment, the cup section 12 consists of the side portion 12*a*, central portion 12*b*, and front center portion 12*c*, but the present invention is by no means limited to this configuration. For example, the central portion 12*b* and the front center portion 12*c* may be integrally formed. It is also possible to adopt a configuration wherein the side portion 12*a*, central portion 12*b*, and front center portion 12*c* are integrally formed. It is, however, preferable to configure the side portion 12*a* and the central portion 12*b* located near attaching portion 12*d* of the shoulder strap section 18, as in the present embodiment, because the side portion of the breast can be effectively pressed thereby.

In the present embodiment, the cup section 12 is configured in such a manner that a border between the side portion 12*a* and the central portion 12*b* is defined along a line connecting the vicinity of the attaching portion 12*d* of the shoulder strap section 18 and the vicinity of a lowermost part 12*e* of the verge's line. This achieves efficient hold of the side portion of the breast, which is effective to the breast gathering effect. The second portion 24 is sewn to the front center side of this first portion 22.

The second portion 24 extends from the first portion 22 toward the front center and is configured so that at the front center it can be engaged with the other second portion 24 in the right and left gathering sections through the engagement portions 26. This second portion 24 is isolated from the cup section 12 and has elasticity in the horizontal direction. This results in letting the second portion 24 act to gather the breast toward the front center.

One end of the second portion 24 is preferably sewn to the first portion 22 in the neighborhood of range 12*f* of virtually three quarters of a length from the vicinity of the lowermost part 12*e* of the verge's line to the vicinity of the attaching portion 12*d* of the shoulder strap section 18, ranging from the lowermost part 12*e*. On the other hand, the other end of the second portion 24, i.e., the engagement portion 26 is preferably engaged with the other at a position on the front center corresponding to a range 12*h* of about two thirds of a normal from a bust top 12*g* to a lowermost line connecting the lowermost parts 12*e* of the right and left verge's lines, ranging from the lowermost line.

In other words, the second portion 24 has a virtually triangular shape the base of which extends along the verge's line, such that its width gradually decreases from the first portion 22 toward the front center. Owing to this configuration, the horizontal length of the second portion 24 gradually decreases in a direction of an arrow shown in FIG. 2, i.e., from the upper side to the lower side. This results in gradually decreasing, from the upper side to the lower side, elongation of the second portion 24 when horizontally pulled by the same force. As a consequence, the horizontal elasticity of the second portion 24 becomes gradually weaker from the upper side to the lower side. The second portion 24 has the horizontal elasticity varied by vertical change of the material of different elasticity, but the present invention is not limited to this configuration. For example, the second portion 24 may be constructed by vertically joining materials of different elasticities so that the horizontal elasticity becomes gradually weaker from the upper side to the lower side. In this construction, the second portion 24 functions in such a manner that a force to press the cup section 12 toward the breast, becomes gradually stronger form the upper side to the lower side, whereby the second portion 24 acts to strongly gather and push up the breast on the lower side. The engagement portion 26 is coupled to the end of this second portion 24 on the front center side. In the case where the horizontal elasticity is varied by the change of the materials making up the second portion, the second portion 24 does not have to be formed so that the width thereof gradually decreases toward the front center. In the present embodiment, the base of the second portion 24 is provided along the verge's line, but the present invention is not limited to this. The base of the second portion 24 does not always have to extend along the verge's line as long as the breast can be satisfactorily gathered toward the front center.

Figure 3:
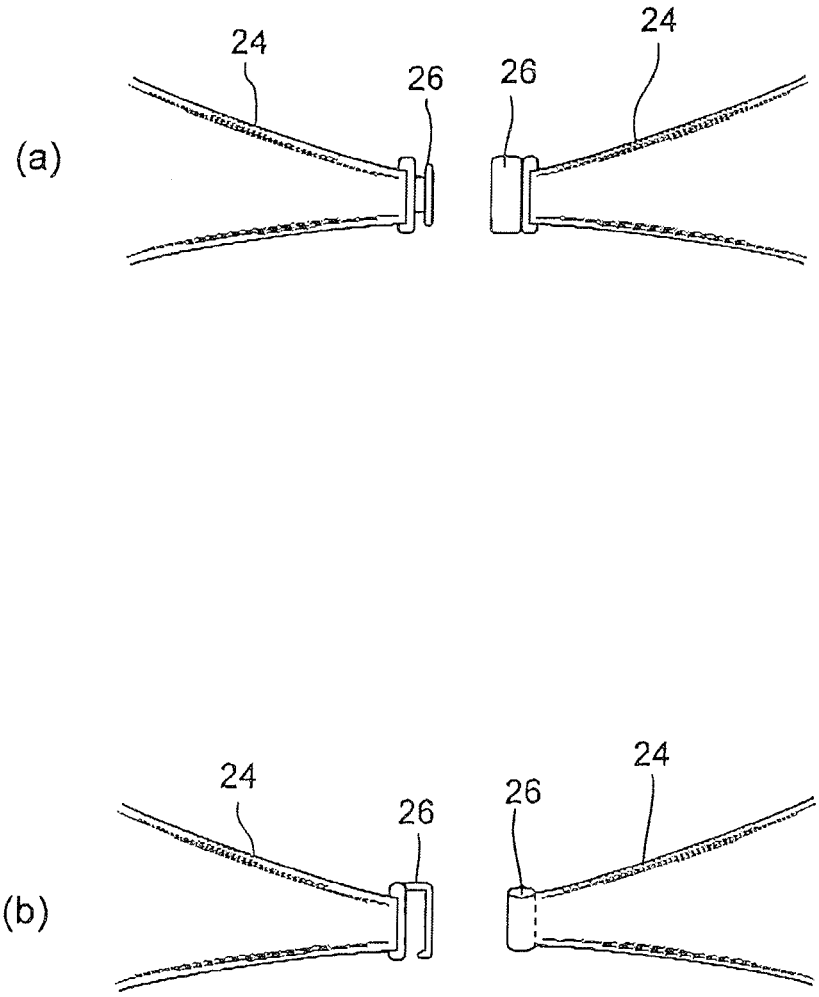
FIG. 3 is a drawing showing enlarged views of engagement portions in gathering sections shown in FIG. 1.

FIG. 3 shows enlarged views of engagement portions 26. The engagement portions 26 are provided for engaging the right and left gathering sections at the front center and the right and left engagement portions 26 are formed so that they can engage with each other. The engagement portions 26 may be configured by applying a hook fastener commonly used for front fastening brassieres, as shown in FIG. 3 (*a*), which is a hook and eye vertically engaged in a 90° rotated state and secured by 90° return in a reverse rotation direction. Furthermore, the engagement portions 26 can also be configured, for example, by applying a combination of a Z metal fitting (also called Z ring) and a Z receiver by sewing of folded fabric widely used for coupling of the shoulder strap sections 18 to the cup sections 12 and the back belt sections 16, as shown in FIG. 3 (*b*).

Figure 4:
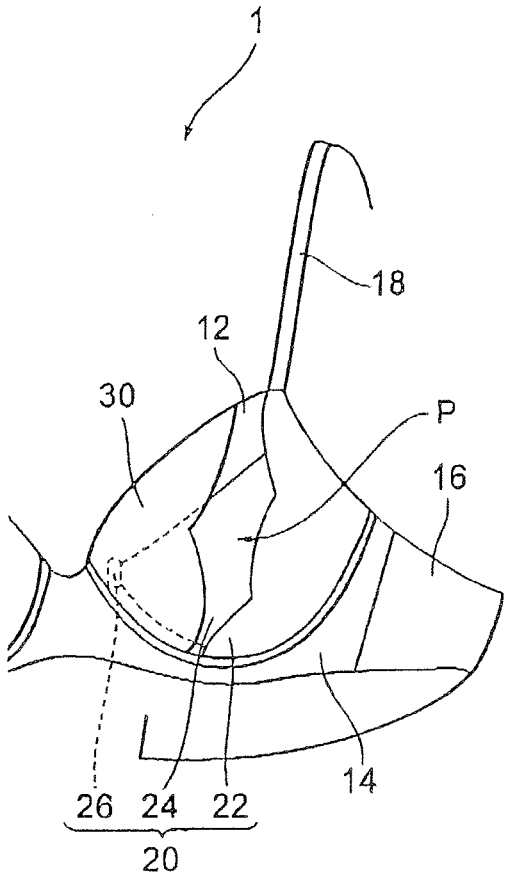
FIG. 4 is a drawing showing a fastening state of the brassiere shown in FIG. 1.

In the present embodiment, the engagement portion 26 can be fastened and housed in the fabric member 30 when the engagement portions in the gathering sections 20 are disengaged. For example, as shown in FIG. 4, the fabric member 30 is a fabric with elasticity and is sewn, with its side opening, to the front side of the front center portion 12*c* in the cup section 12. In this manner, a packet (fastening portion) P is composed of the fabric member 30 and the cup section 12, and the engagement portion 26 and the second portion 24 are housed in this pocket P, whereby the engagement portion 26 and the second portion 24 can be fastened therein.

In the brassiere 1 of the present embodiment, as described above, the second portion 24 in the gathering section 20 has the elasticity in the horizontal direction and therefore it acts to gather the breast forward. On the other hand, the first portion 22 in the gathering section 20 is sewn to the side portion 12*a* of the cup section 12 and has the elasticity weaker (or lower) than the second portion 24; therefore, it acts to hold the side portion of the breast. Accordingly, the gathering force by the second portion 24 can be efficiently transferred from the first portion 22 to the side portion of the breast, so as to enhance the breast shaping performance.

In the brassiere 1 of the present embodiment, the force of the second portion 24 to press the cup section 12 toward the breast becomes gradually stronger from the upper side to the lower side, and thus the gathering section 20 acts to push up the breast from the lower side, so as to further enhance the breast shaping performance.

In the brassiere 1 of the present embodiment, the first portion 22 transmits the gathering force by the second portion 24 to the breast. In this manner, the gathering force by the second portion 24 is transmitted to the breast without intervention of the back belt section 16 and the shoulder strap section 18 and, therefore, the gathering force of the second portion 24 is less likely to be transmitted to the back belt section 16 and the shoulder strap section 18. For this reason, the aforementioned gathering force can be made to act on the breast, while suppressing increase in tightening force on the wearer's body by the back belt section 16 and the shoulder strap section 18. In this way, the brassiere 1 of the present embodiment achieves the high breast shaping performance and the comfortable wear feeling together.

Furthermore, since the brassiere 1 of the present embodiment is provided with the engagement portions 26 in the gathering sections 20, when the main body section 10 is put on the wearer's body, the first portions 22 first hold the side portions of the breasts and then the second portions 24 are engaged with each other to efficiently gather and push up only the breasts from the side portions of the breasts toward the front center. Therefore, the breast shaping performance is more enhanced and the tight pressure feeling due to the back belt sections 16 and the shoulder strap sections 18 is further suppressed.

Furthermore, since the brassiere 1 of the present embodiment is provided with the fabric members 30, the engagement portions 26 and the second portions 24 can be fastened therein so as not to become obstacles when the brassiere is worn without engagement of the gathering sections 20, i.e., when the breasts need not be gathered.

The present embodiment showed the hook fastener as an example of the engagement portions 26 and showed the example in which the pocket P was formed of the fabric member 30 and the cup section 12. However, the present invention is not limited to this configuration, but a variety of modes can be applied to the engagement portions 26 and the fabric members 30. The below will describe several modification examples of the engagement portions and the fastening portions. In the drawings identical or equivalent portions will be denoted by the same reference signs.

Modification Example 1 of Engagement Portions and Fastening Portions

Figure 5:
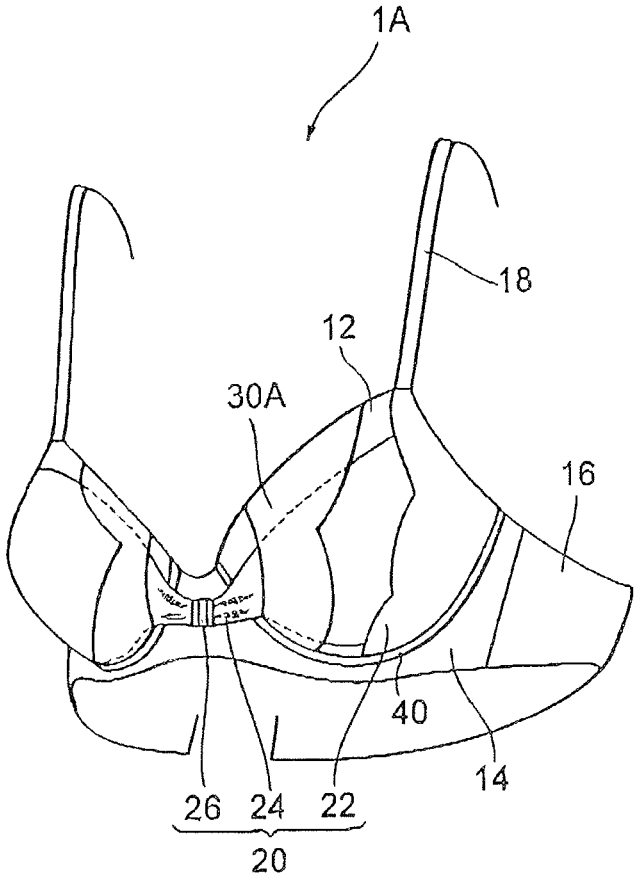
FIG. 5 is a drawing showing a brassiere according to modification example 1 of the present invention.
Figure 6:
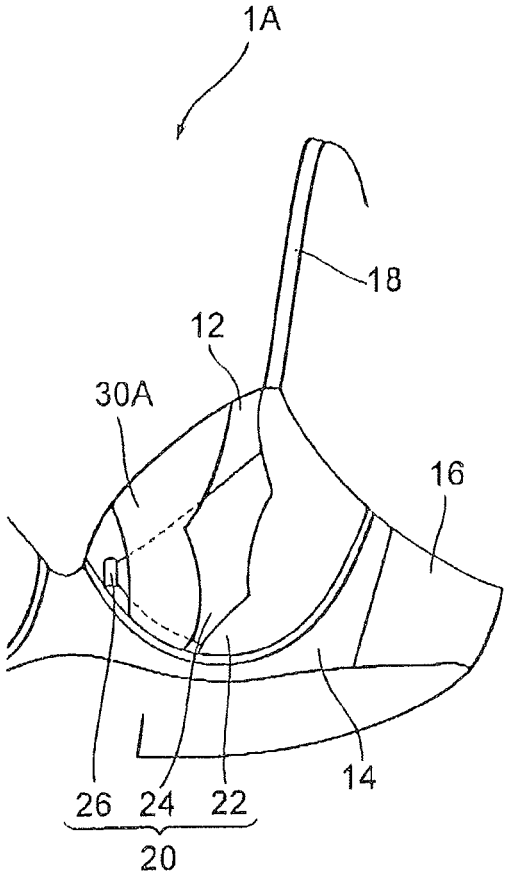
FIG. 6 is a drawing showing a fastening state of the brassiere shown in FIG. 5.

FIG. 5 is a drawing showing a brassiere according to modification example 1 of the present invention and FIG. 6 a drawing showing a state in which the engagement portions 26 of the brassiere shown in FIG. 5 are disengaged. This brassiere 1A of modification example 1 is different from the foregoing embodiment in a configuration provided with fabric members 30A, instead of the fabric members 30 in the brassiere 1.

The fabric member 30A is attached to the cup section 12 so as to form a hollow space penetrating from the side toward the front center, between it and the cup section 12. This causes the second portion 24 to be fastened as sandwiched in between the fabric member 30A and the cup section 12. When the engagement portions 26 are disengaged, the second portion 24 is pulled toward the side of the cup section 12 through the first portion 22 and thus displaced to the side. The second portion 24 is displaced toward the side up to a position where the engagement portion 26 attached at the end on the front center side is in contact with the cup section 12 or with the fabric member 30A. In this manner, when the engagement portions 26 are disengaged, each engagement portion 26 is fastened in a state in which it is in contact with at least one of the cup section 12 and the fabric member 30A near an opening on the front center side of the cup section 12 and the fabric member 30A.

Modification Example 2 of Engagement Portions and Fastening Portions

Figure 7:
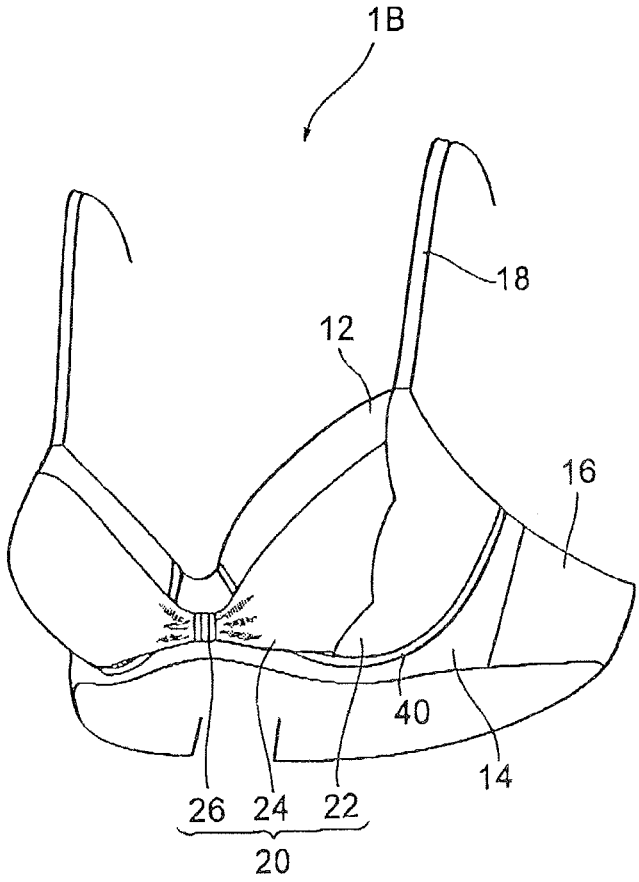
FIG. 7 is a drawing showing a brassiere according to modification example 2 of the present invention.
Figure 8:
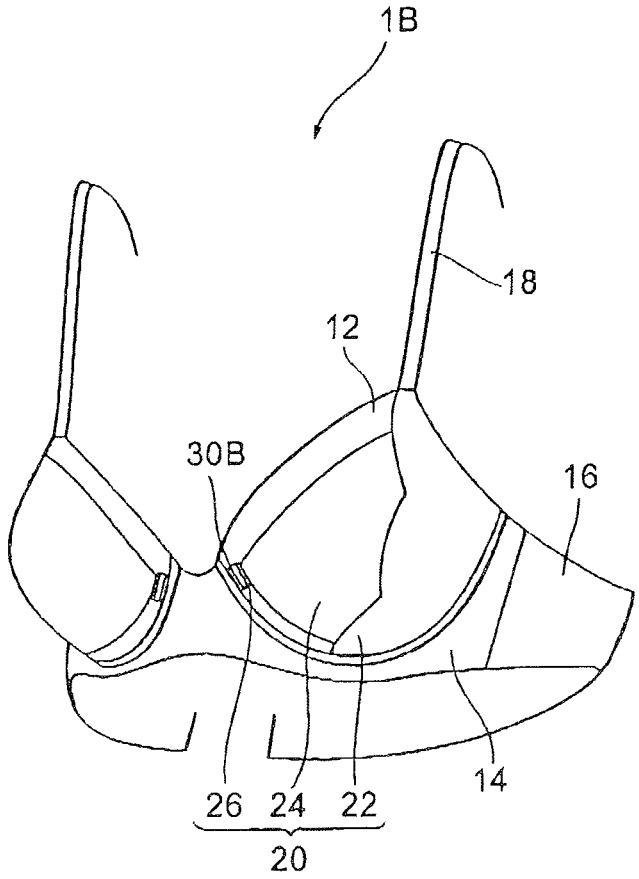
FIG. 8 is a drawing showing a fastening state of the brassiere shown in FIG. 7.

FIG. 7 is a drawing showing a brassiere according to modification example 2 of the present invention and FIG. 8 a drawing showing a state of change in position where the engagement portion 26 of the brassiere shown in FIG. 7 is fastened. This brassiere 1B of modification example 2 is different from the aforementioned embodiment in a configuration provided with fabric members 30B, instead of the fabric members 30 in the brassiere 1.

Figure 9:
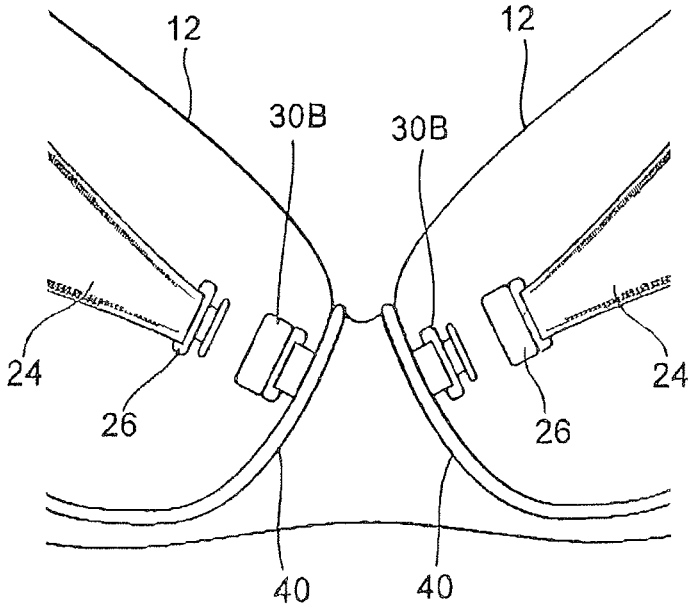
FIG. 9 is a drawing showing an enlarged view of fastening portions shown in FIG. 8.

FIG. 9 shows an enlarged view of the fabric members 30B. The fabric member 30B is one of the aforementioned hook fastener formed so as to be able to engage with the engagement portion 26, or the aforementioned Z metal fitting and Z receiver, and is coupled to the edge on the front center side in the cup section 12. For example, the fabric member 30B is coupled to a tab sewn to the edge on the front center side in the cup section 12. In this way, when the brassiere is worn with the engagement portions in the gathering sections 20 being disengaged, the engagement portion 26 and the second portion 24 can be fastened so as not to become obstacles.

Modification Example 3 of Engagement Portions and Fastening Portions

Figure 10:
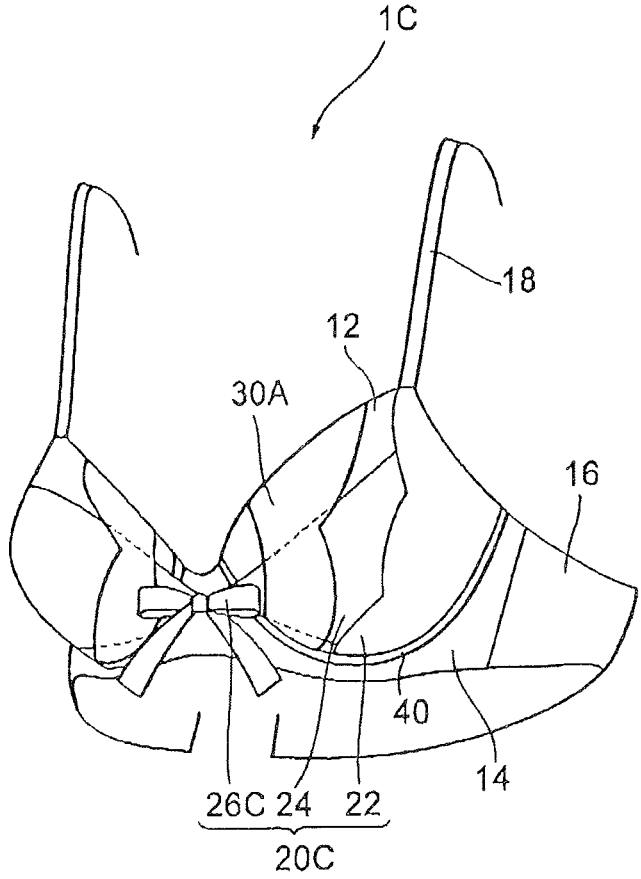
FIG. 10 is a drawing showing a brassiere according to modification example 3 of the present invention.
Figure 11:
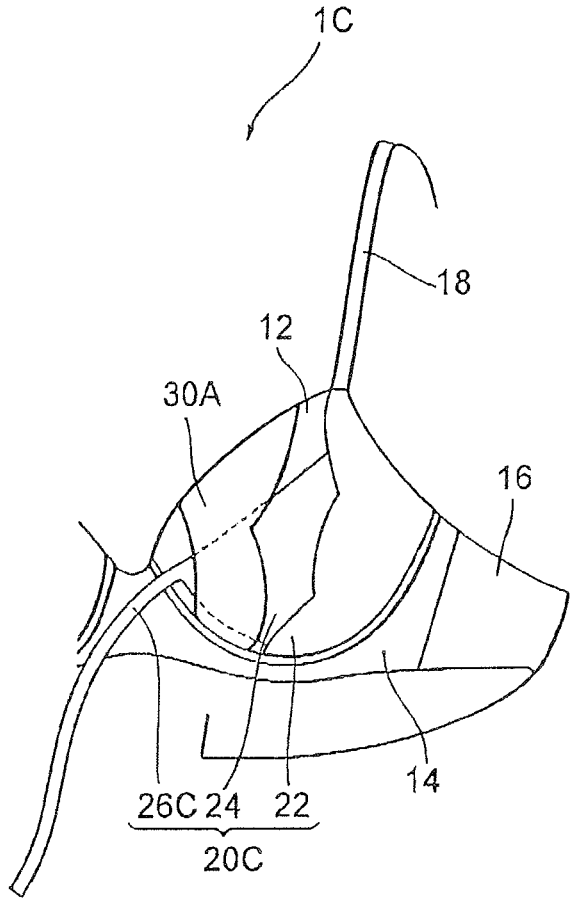
FIG. 11 is a drawing showing a fastening state of the brassiere shown in FIG. 10.

FIG. 10 is a drawing showing a brassiere according to modification example 3 of the present invention and FIG. 11 a drawing showing a state in which engagement portions 26C (which will be detailed below) of the brassiere shown in FIG. 10 are disengaged. This brassiere 1C of modification example 3 is different from the aforementioned modification example 1 in that it is provide with gathering sections 20C, instead of the gathering sections 20 in the brassiere 1A.

The gathering section 20C is different from the gathering section 20 in a configuration provided with an engagement portion 26C, instead of the engagement portion 26 in the gathering section 20. The engagement portion 26C is a ribbon-like cord and one end thereof is sewn to one end on the front center side of the second portion 24. In this modification example 3, the ribbon-like cords of the right and left engagement portions 26C are configured so that they can be engaged with each other as tied together at the front center.

In this modification example 3, the engagement portion 26C and the second portion 24 in the gathering section 20C can also be engaged as fastened between the fabric member 30A and the cup section 12. When the engagement portions 26C are disengaged, the engagement portion 26C can be autonomously fastened near the opening of the fabric member 30A by returning force of the gathering section 20C. In this fastening state, it is also preferable to tie the engagement portions 26C at a position where the wearer can feel comfortable.

In this modification example 3, when the right and left engagement portions are engaged, the tying position can be adjusted so as to control the degree of breast gathering or the degree of breast shaping.

Modification Example 4 of Engagement Portions and Fastening Portions

Figure 12:
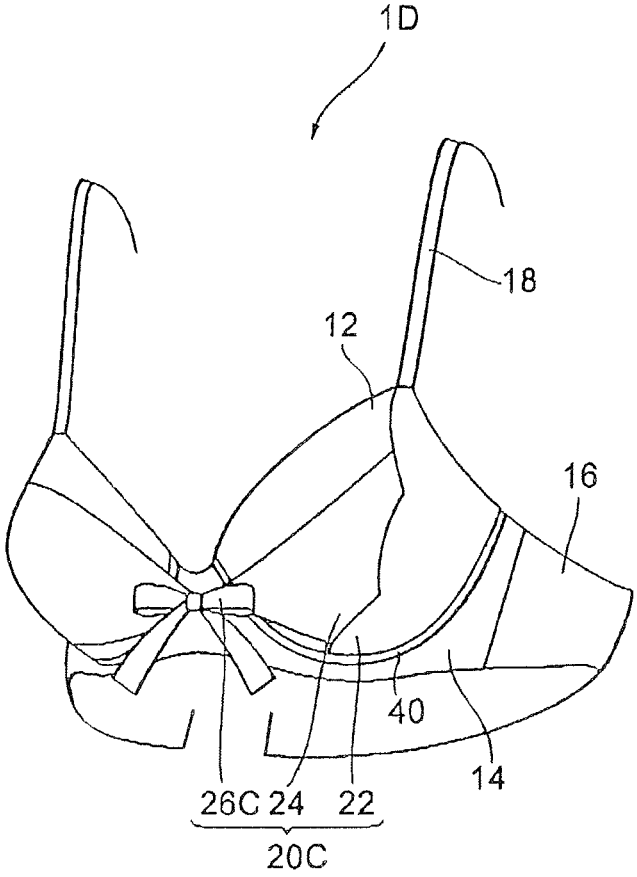
FIG. 12 is a drawing showing a brassiere according to modification example 4 of the present invention.

FIG. 12 is a drawing showing a brassiere according to modification example 4 of the present invention. This brassiere 1D is different from the above modification example 3 in a configuration without the fabric members 30A in the brassiere 1C.

In this modification example 4, the engagement portions 26C in the gathering sections 20C have the function as fastening means. For example, when the engagement portions 26C are disengaged, the engagement portions 26C can be fastened as tied at any position where the wearer can feel comfortable. Furthermore, this modification example 4 also allows the wearer to adjust the degree of breast shaping at the time of engaging the right and left engagement portions 26C, as described above.

Modification Example 5 of Engagement Portions and Fastening Portions

Figure 13:
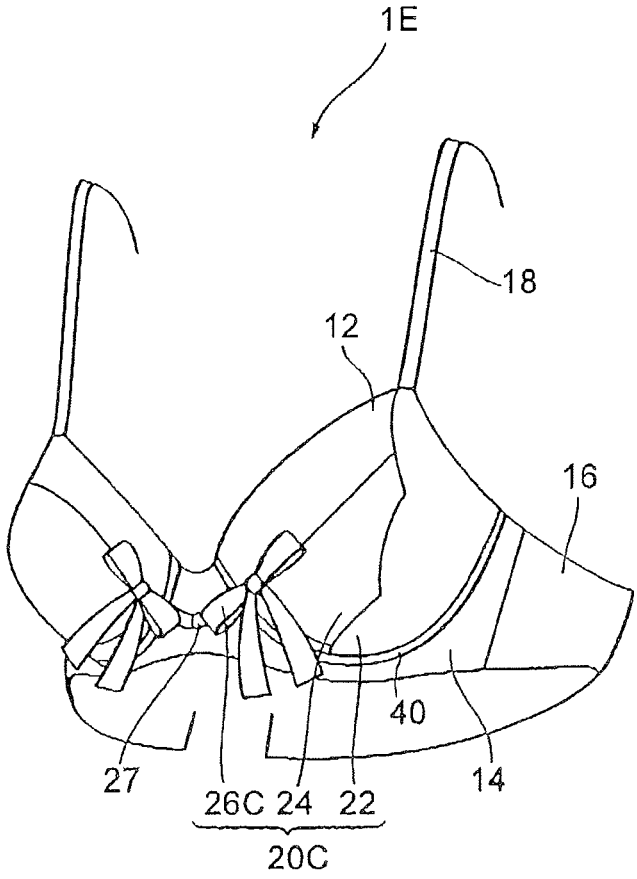
FIG. 13 is a drawing showing a brassiere according to modification example 5 of the present invention.
Figure 14:
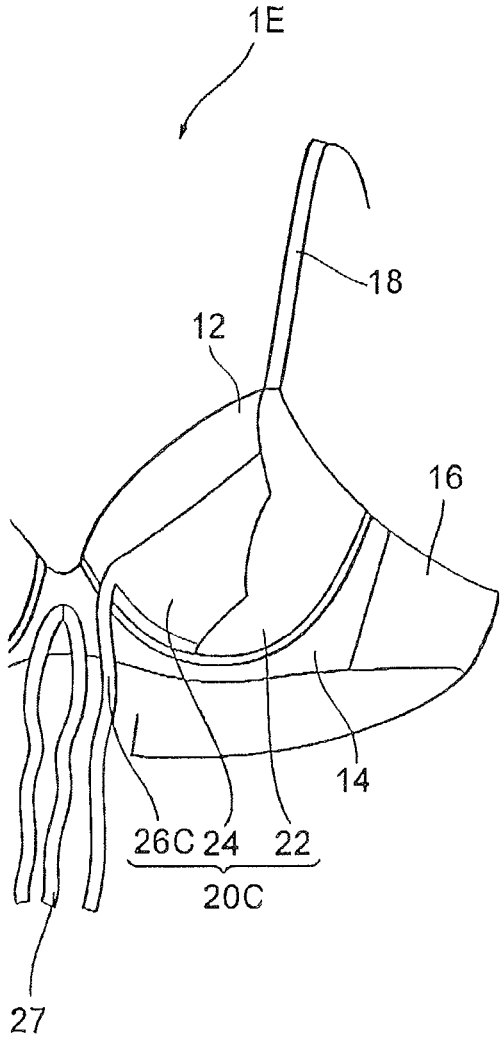
FIG. 14 is a drawing showing a detailed configuration of engagement portions of the brassiere shown in FIG. 13.

FIG. 13 is a drawing showing a brassiere according to modification example 5 of the present invention and FIG. 14 a drawing showing a detailed configuration of the engagement portions of the brassiere shown in FIG. 13. This brassiere 1E of modification example 5 is different from the above modification example 4 in a configuration further provided with engagement portions 27 in the brassiere 1D.

The engagement portion 27 is a ribbon-like cord and one end thereof is sewn to the front center portion of the base section 14. In this modification example 5, the ribbon-like cord of the engagement portion 27 is tied with the ribbon-like cord of the engagement portion 26C thereby achieving engagement between them.

In this modification example 5, the engagement portion 26C in the gathering section 20C and the engagement portion 27 function as fastening means. For example, when the engagement between the engagement portion 26C and the engagement portion 27 is released, they can be fastened as tied at any position where the wearer can feel comfortable. Furthermore, this modification example 5 also allows the wearer to adjust the degree of breast gathering or the degree of breast shaping by changing combinations of the four ribbon-like cords of the right and left engagement portions 26C and the right and left engagement portions 27, e.g., as described above, by adjusting the tying positions in engaging the right and left engagement portions 26C and the engagement portions 27, or by tying the right and left engagement portions 26C with each other.

Modification Example 6 of Engagement Portions and Fastening Portions

Figure 15:
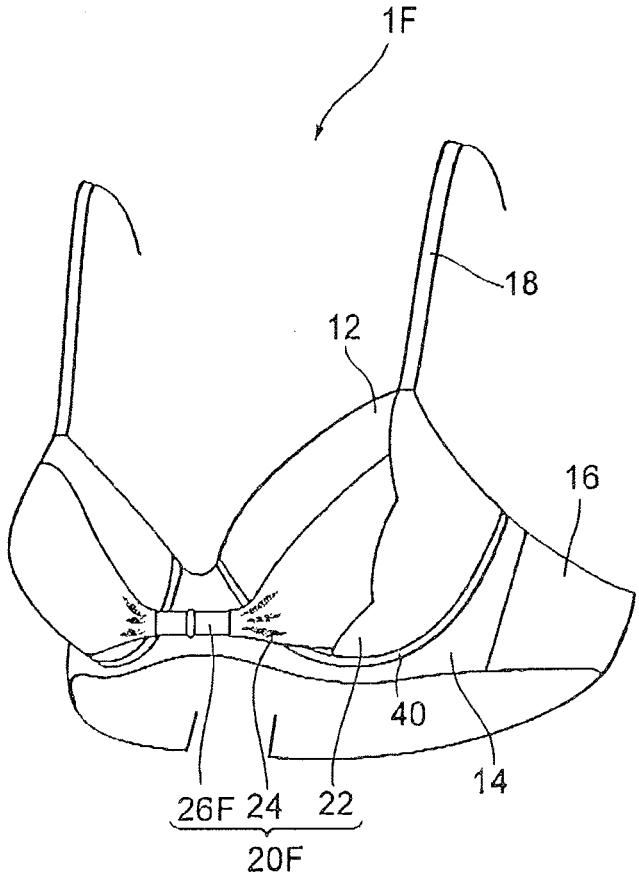
FIG. 15 is a drawing showing a brassiere according to modification example 6 of the present invention.
Figure 16:
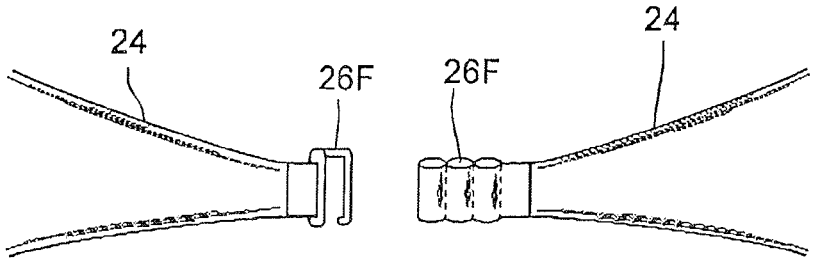
FIG. 16 is a drawing showing an enlarged view of engagement portions of the brassiere shown in FIG. 15.

FIG. 15 is a drawing showing a brassiere according to modification example 6 of the present invention and FIG. 16 a drawing showing an enlarged view of the engagement portions in the brassiere shown in FIG. 15. This brassiere if of modification example 6 is different from modification example 4 in a configuration provided with gathering sections 20F, instead of the gathering sections 20C in the brassiere 1D.

The gathering section 20F is different from the gathering section 20C in a configuration provided with an engagement portion 26F, instead of the engagement portion 26C in the gathering section 20C. The engagement portions 26F include the aforementioned Z metal fitting and Z receiving portions, and tapes. For example, one of the right and left engagement portions 26F includes a Z metal fitting sewn through a tape to the second portion 24, and the other of the right and left engagement portions 26F includes a plurality of Z receiving portions arranged horizontally, while sewn partitions are made by folding and sewing one end of a tape sewn at the other end to the second portion 24.

In this modification example 6, the engagement portions 26F in the gathering sections 20F also function as fastening means. For example, when the engagement portions 26F are disengaged, the engagement portions 26F can be fastened as engaged at a position where the wearer can feel comfortable. In this modification example 6, the degree of breast gathering or the degree of breast shaping can be adjusted by selecting one of the plurality of Z receiving portions arranged horizontally in the engagement portion 26F.

Modification Example 7 of Engagement Portions and Fastening Portions

Figure 17:
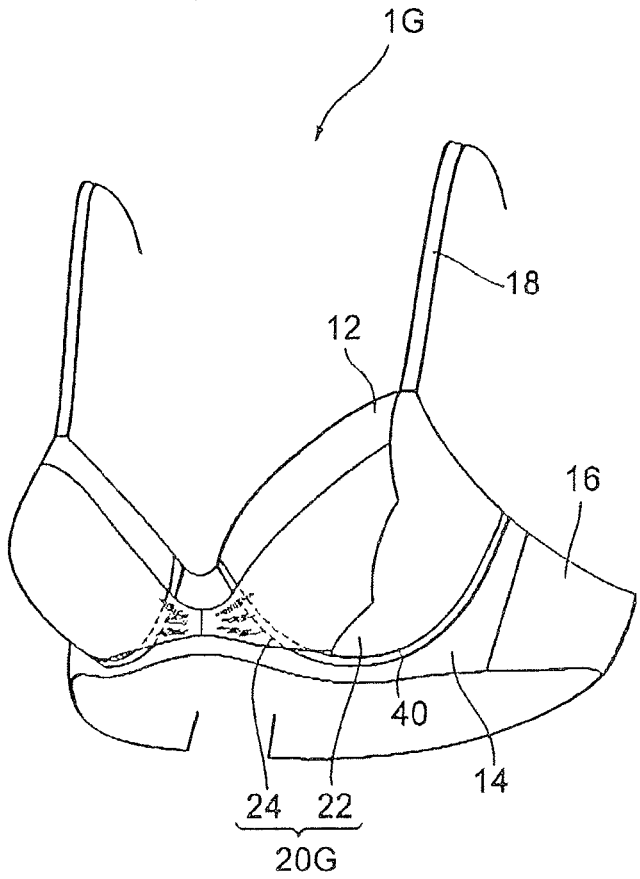
FIG. 17 is a drawing showing a brassiere according to modification example 7 of the present invention.

FIG. 17 is a drawing showing a brassiere according to modification example 7 of the present invention. This brassiere 1G is different from the present embodiment in a configuration provided with gathering sections 20G, instead of the gathering sections 20 in the brassiere 1, and without the fabric members 30.

Figure 18:
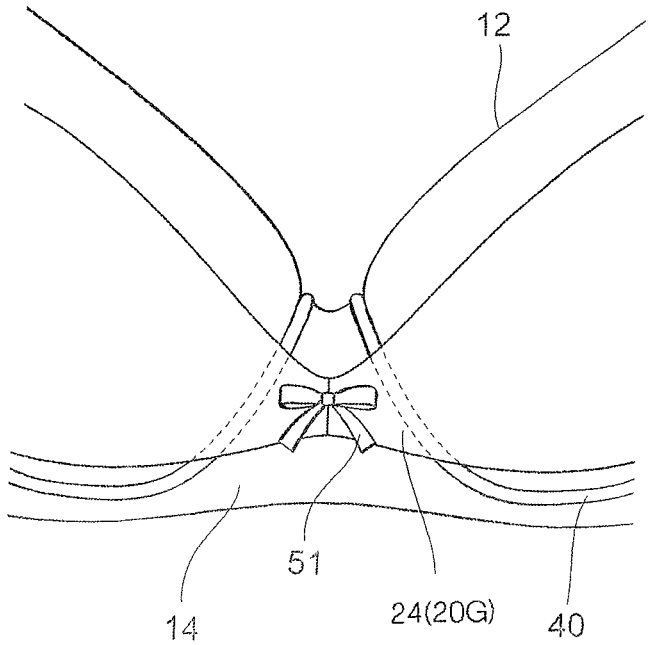
FIG. 18 is a drawing showing enlarged views of front center portions of the brassiere shown in FIG. 17.
Figure 18:
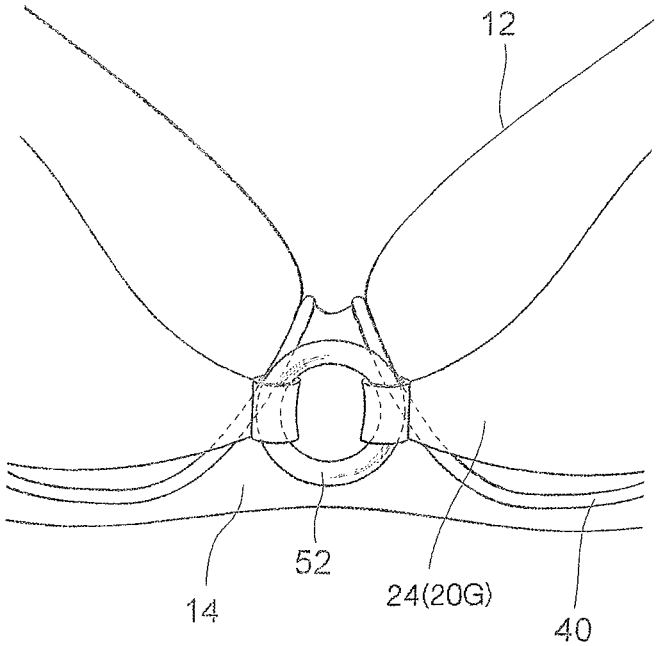

The gathering section 20G is different from the gathering section 20 in a configuration without the engagement portion 26 in the gathering section 20. In the gathering sections 200, the ends of the right and left second portions 24 are sewn at the front center. As shown in FIG. 18 (*a*), this sewn part is preferably fastened to the base section 14 with an ornament like a ribbon thereon. This configuration stabilizes the position of gathering sections 20G.

Furthermore, as shown in FIG. 18 (*b*), the right and left second portions 24 may be engaged through a ring-like ornament 52 at the front center. In this case, the ends of the right and left second portions 24 may be folded around the ring-like ornament 52 and sewn.

The present invention can be modified in many ways without being limited to the above-described embodiment and modification examples. The embodiment and modification examples showed the examples of brassieres provided with the cup wires 40, but the features of the embodiment and modification examples are also applicable to brassieres of the wireless type without cup wires, as described above.

The embodiment and modification examples showed the examples of brassieres of the type in which the back ends of the back belt sections 16 are latched through the hook fastener or the like, but the features of the embodiment and modification examples are also applicable to brassieres of the front fastening type in which the base section 14 is separated into right and left base portions at the front center and they are latched there through a hook fastener or the like.

The features of the embodiment and modification examples are also applicable to brassieres of all types such as full cup brassieres, ¾ cup brassieres, and half cup brassieres.

The features of the embodiment and modification examples are also applicable to any cup-possessing garments other than brassieres, e.g., bra-slips, bra-camisoles, bodysuits, cup-possessing teddies, swimsuits, and so on.

Example 1

Brassieres 1 of the embodiment of the present invention shown in FIG. 1 were produced as Example and were evaluated by sixteen monitors ranging in age from late 10s to 40s. This evaluation was conducted by comparative evaluation between Example and conventional products.

The conventional products for the comparison with Example of the present invention were commercial products manufactured by the applicant and other companies and major products of brassieres with high shaping performance all of which are popular among women of late 10s to 40s. The features and specifications of these conventional products are as follows.

Conventional product A: regarded as "easy shaping type," a type to provide weak tightening at the under bust and relatively give priority to the easy wear feeling with the back belt sections of hems (seamless) so as to create a beautiful bust line by natural shaping. This product is the ¾ cup type and has no pads.

Conventional product B: regarded as "clear side and breast lift type," a type to Emily support the back sides so as to lift breasts, i.e., to relatively give priority to the breast shaping performance including gathering, lifting, and side holding. This product is the ¾ cup type and has pads.

Conventional product C: regarded as "clear side and cleavage makeup," a type to relatively give priority to the breast shaping performance so as to create a cleavage, while achieving clear appearance of the sides by sheets of the back sides and panels of the cup sides. This product is the ¾ cup type and has pads.

In this evaluation, each monitor was asked which one she felt superior in comparison between Example of the present invention and each of the conventional products. The evaluation results are provided in Table 1. In Table 1, answers of confirming superiority of Example of the present invention are indicated by circle mark, answers of telling no significant difference are indicated by triangle mark, and answers of confirming superiority of the conventional one are indicated by cross mark.

TABLE 1

| Type of conventional product compared | Superiority in shaping | | Superiority in wear feeling | | Preference | |
|---|---|---|---|---|---|---|
| Conventional Product A | ○ | 16 | ○ | 8 | ○ | 10 |
| | ∇ | 0 | ∇ | 2 | ∇ | 3 |
| | X | 0 | X | 6 | X | 3 |

TABLE 1-continued

| Type of conventional product compared | Superiority in shaping | | Superiority in wear feeling | | Preference | |
|---|---|---|---|---|---|---|
| Conventional Product B | ○ | 7 | ○ | 9 | ○ | 11 |
| | ∇ | 6 | ∇ | 3 | ∇ | 2 |
| | X | 3 | X | 4 | X | 3 |
| Conventional Product C | ○ | 9 | ○ | 13 | ○ | 12 |
| | ∇ | 1 | ∇ | 1 | ∇ | 1 |
| | X | 6 | X | 2 | X | 3 |

According to the evaluation results, the numbers of women who felt better in shaping performance or breast shape with Example than with the brassieres having the conventional shaping functions were larger than those with any other products. To be noted herein as to this superiority of shaping performance is that Example of the present invention gained higher evaluation throughout every age than the conventional products B and C with highly-evaluated shaping performance.

Furthermore, the numbers of women who felt easier and more comfortable in wear feeling or wearing sensation with Example than with the conventional brassieres were larger than those with any other products. To be noted herein as to this superiority of wear feeling is that Example of the present invention gained higher evaluation than the conventional product A with highly-evaluated easy shaping and comfortable wear feeling.

As described above, according to the evaluation results, Example of the present invention can be believed to be the brassiere achieving both of high shaping performance and comfortable wear feeling. Furthermore, more women wanted to wear Example of the present invention than the conventional products and gave favorable comments across the wide range of age from late 10s to 40s.

INDUSTRIAL APPLICABILITY

The present invention is applicable to such use as to enable achievement of high breast shaping performance and comfortable wear feeling together.

| List of Reference Signs | |
|---|---|
| 1, 1A, 1B, 1C, 1D, 1E, 1F, 1G | brassieres (garments with cup sections) |
| 10 | main body section |
| 12 | cup section |
| 12a | side portion |
| 12b | central portion |
| 12c | front center portion |
| 12d | attaching portion of shoulder strap section |
| 12e | lowermost part of verge's line |
| 12f | range |
| 12g | bust top |
| 12h | range |
| 14 | base section |
| 16 | back belt section |
| 18 | shoulder strap section |
| 20, 20C, 20F, 20G | gathering section |
| 22 | first portion |
| 24 | second portion |
| 26, 26C, 26F, 27 | engagement portion |

-continued

| List of Reference Signs | |
|---|---|
| 30, 30A, 30B | fabric member |
| 40 | cup wire |
| 51 | ribbon-like ornament |
| 52 | ring-like ornament |
| P | pocket (fastening portion) |

The invention claimed is:

1. A cup-possessing garment comprising:

a pair of cup sections for covering respective breasts, each cup section comprising a front face, a front center portion, and a side portion, wherein the side portion is located by a lateral side of a wearer's breast; and a pair of gathering sections joined together to cover at least partial areas of the front faces of the respective cup sections in order to gather the pair of cup sections toward a front center between the wearer's breasts, wherein each of the pair of gathering sections is composed of a first portion, a second portion, and an engagement portion, wherein the first portion is attached to the side portion of the cup section, and to the second portion, the second portion having a second portion end connected to the engagement portion, the second portion being formed with higher elasticity than the first portion, wherein the engagement portions join the second portion ends together.

2. The cup-possessing garment according to claim 1, wherein the second portions in the pair of gathering sections are configured in such a manner that, when joined together, push the cup sections upwards from lower sides of the wearer's breasts.

3. The cup-possessing garment according to claim 2, wherein the second portion in the gathering section has a virtually triangular shape, the triangular shape having a base extending along a base boundary line, such that second portion has a width that gradually decreases from the first portion toward the front center portion of the cup section.

4. The cup-possessing garment according to claim 3, further comprising:

a shoulder strap section attached to the cup section, the cup section having a lower boundary line, wherein the second portion in the gathering section is sewn to the first portion at a location ranging from about three quarters of a length from near the cup section lower boundary line to near the attachment of shoulder strap section to the cup section, and wherein one second portion in the gathering section engages with the other second portion in the pair of gathering sections, at a position on the front center portion of the cup section.

5. The cup-possessing garment according to claim 1, further comprising:

a shoulder strap section attached to the cup section, wherein the cup section has a lower boundary line and the side portion is joined to the cup section along a line extending from near the attachment of the shoulder strap section to the cup section to near the lower boundary line.

6. The cup-possessing garment according to claim 1, further comprising:

a fastening portion for fastening the engagement portion.

* * * * *